US005851314A

United States Patent [19]

Gräfen et al.

[11] Patent Number: 5,851,314

[45] Date of Patent: Dec. 22, 1998

[54] METHOD FOR PLASMA CARBURIZATION OF METAL WORKPIECES

[75] Inventors: Winfried Gräfen, Duisburg; Bernd Edenhofer, Kleve, both of Germany

[73] Assignee: Ipsen International GmbH, Kleve, Germany

[21] Appl. No.: 766,282

[22] Filed: Dec. 13, 1996

[30] Foreign Application Priority Data

Dec. 16, 1995 [DE] Germany ..... 195 47 131.8

[51] Int. Cl.[6] ..... C23C 8/20

[52] U.S. Cl. ..... 148/222

[58] Field of Search ..... 148/222

[56] References Cited

U.S. PATENT DOCUMENTS 5,383,980 1/1995 Melber et al. ..... 148/222

5,558,725 9/1996 Schatbaum et al. ..... 148/222

FOREIGN PATENT DOCUMENTS 58113371 7/1983 Japan .

OTHER PUBLICATIONS

Chemical Abstracts, vol. 102, No. 26, 1 Jul. 1985.

Urs Wyss; Aspekte des Unterdruck–und Plasmaaufkohlens pp. 103–111, 1994.

*Primary Examiner*—Deborah Yee

*Attorney, Agent, or Firm*—Robert W. Becker & Associates

[57] ABSTRACT

A method for plasma carburization of metal workpieces in a furnace includes the step of introducing a mixture of propane and methane into the furnace atmosphere. The propane and methane mixture is cleaved under process conditions of plasma carburization to release pure carbon into the furnace atmosphere.

8 Claims, 1 Drawing Sheet

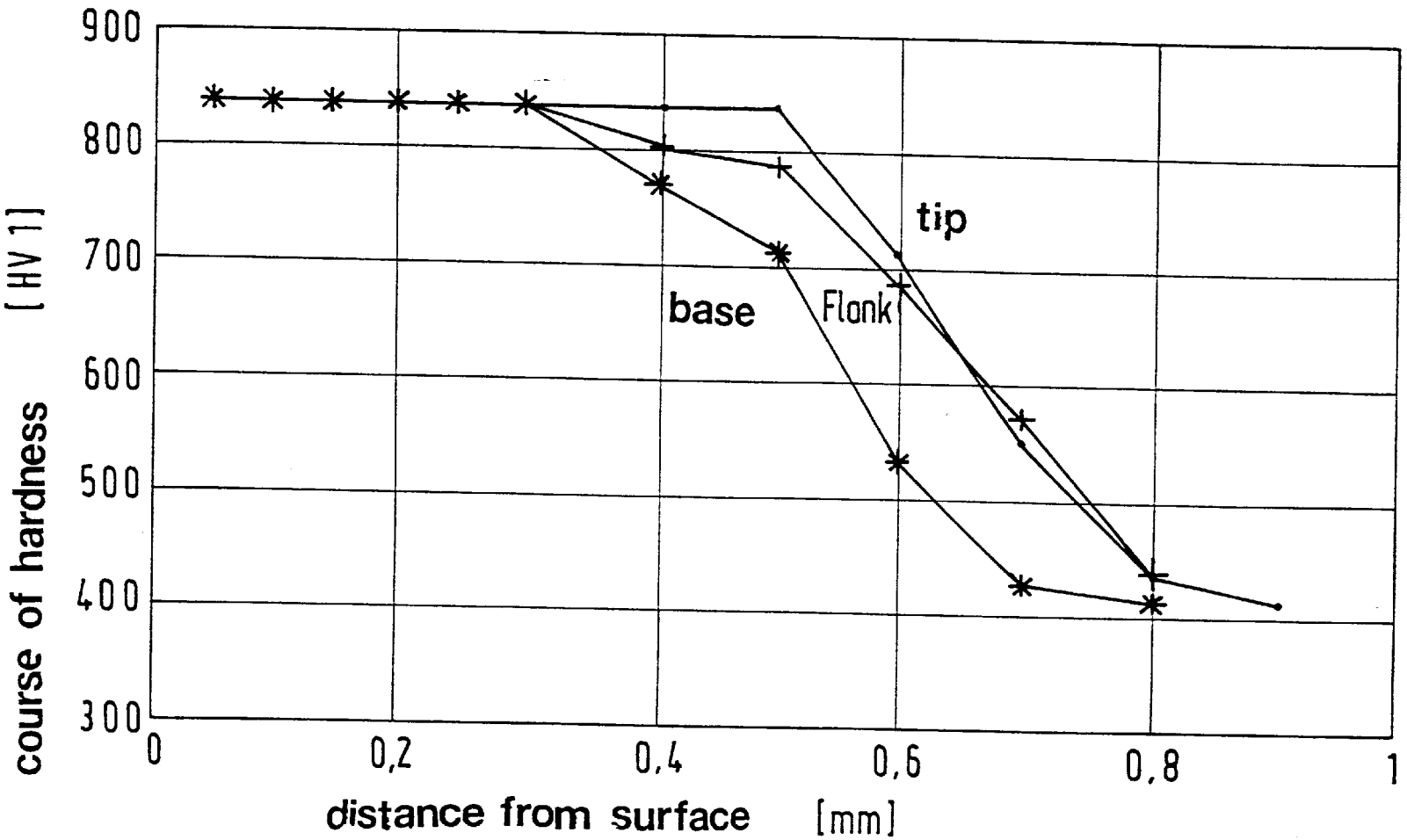
course of hardness
[HV 1]
900
800
700
600
500
400
300
0
0,2
0,4
0,6
0,8
1
distance from surface [mm]
tip
Flank
base

METHOD FOR PLASMA CARBURIZATION OF METAL WORKPIECES

BACKGROUND OF THE INVENTION

The present invention relates to a method for plasma carburization of metal workpieces in a furnace, whereby the furnace atmosphere contains a carbon-containing medium that under the process conditions of plasma carburization is cleaved to release pure carbon.

Among the thermo-chemical treatment processes for carburization of metal workpieces carburization processes in vacuum furnaces have become more and more popular in recent years in addition to the conventional gas carburization processes because only with the former methods a carburization free of edge oxidation can be realized. The carburization processes performed in vacuum furnaces include low-pressure carburization and plasma carburization. Since in these carburization processes reaction gases that are free of oxygen are employed, a carbon level control cannot be performed. The decisive characteristic value for the carbon transfer in these methods is the carbon mass flow density which is defined as the amount of carbon that is transferred per unit of time and unit of surface area. The amount of carbon required for carburization is provided by a carbon-containing medium contained within the furnace atmosphere, conventionally in the form of a hydrocarbon, that is cleaved under the process conditions to release pure carbon.

In known low-pressure carburization processes the carbon-containing medium is, in general, propane ($C_3H_8$) which in the course of the so-called propane pyrolysis is cleaved according to the following reactions:

$$C_3H_8 \rightarrow CH_4 + C_2H_4$$

$$C_2H_4 \rightarrow 2C + 2H_2$$

$$CH_4 \rightarrow C + 2H_2$$

In the plasma carburization process the carbon-containing medium is usually methane ($CH_4$) which is cleaved according to the methane pyrolysis reaction according to the formula $$CH_4 \rightarrow C + 2H_2.$$

However, it is also possible to use propane instead of methane for the process of plasma carburization.

The use of methane or propane as a carbon-containing medium has various advantages and disadvantages, respectively. For example, propane, due to its greater number of carbon atoms, three carbon atoms for propane instead of one carbon atom for methane is a more effective carbon carrier than methane. On the other hand, propane has the disadvantage that it is already cleaved by a thermal reaction in a temperature range above 600° C. whereby a carburization takes place in the furnace that leads to carbon deposits within the furnace. Methane, on the other hand, has only one carbon atom but the methane molecule is so stable that it is not readily cleaved at the required carburization temperature. The cleavage is carried out only within the plasma and thus only at the workpiece surface. Since the carbon mass flow density during cleavage of methane is only minimal, workpiece charges with large surface areas can thus be uniformly carburized only with difficulties with methane.

It is therefore an object of the present invention to provide a method for plasma carburization of metal workpieces that ensures a carburization with high carbon mass flow density without running the risk of carbon deposition within the furnace.

SUMMARY OF THE INVENTION

The method for plasma carburization of metal workpieces in a furnace according to the present invention is primarily characterized by the following steps:

Introducing a mixture of propane and methane into the furnace atmosphere of a furnace; and Cleaving propane and methane under process conditions of plasma carburization to release pure carbon into the furnace atmosphere.

Advantageously, the step of introducing includes preparing the mixture with up to 60 vol.-% of propane.

The step of introducing preferably includes preparing the mixture with 5 to 50 vol.-% of propane.

Expediently, the method further comprises the step of adjusting the furnace atmosphere to a pressure of less than 10 mbar.

The step of introducing may include adding gases other than propane and methane to the furnace atmosphere.

The step of introducing may include adding hydrogen and/or argon into the furnace atmosphere.

According to the present invention, the method provides a carbon carrier in the form of a mixture of methane and propane.

The realization of high carbon mass flow density, on the one hand, and the prevention of carbon deposits within the furnace, on the other hand, is possible because propane, due its three carbon atoms, is able to release by thermal and electrical cleavage within the plasma more carbon atoms than methane. Methane, on the other hand, is hardly cleaved in the carburization temperature range between 800° C. and 1000° C. The cleavage of methane occurs only within the plasma, i.e., only at the workpiece surface so that the released carbon atoms participate only in the carburization of the workpieces but do not lead to carbon deposits within the furnace.

In experiments it has been shown that a methane and propane mixture with up to 60 vol.-% propane, especially a propane proportion of 5 to 50 vol.-%, is especially suitable to realize a high carbon mass flow density, respectively, carbon transfer rate without soot (carbon) deposition.

According to a preferred embodiment of the inventive method, the gas pressure within the furnace atmosphere is below 10 mbar because in this pressure range thermal cleavage of methane is substantially impossible.

In addition to the methane/propane mixture, the furnace atmosphere may contain other gases, especially hydrogen and/or argon, which act as inert gases in order to prevent the oxidation of the workpieces.

BRIEF DESCRIPTION OF THE DRAWINGS

In the only drawing a workpiece comprised of 27 CrMo 4 material has been used for carburization and the course of hardness for plasma carburization with a methane/propane mixture as the carbon-containing medium is represented.

DESCRIPTION OF PREFERRED EMBODIMENT

The present invention will now be described in detail with the aid of a specific embodiment utilizing the only Figure.

The process parameters for the plasma carburization represented in the only Figure is as follows:

carburization carried out for 10 minutes at a carburization temperature of 940° C.;

subsequent diffusion phase carried out for 51 minutes;

subsequently, after lowering to the hardening temperature of 860° C., the charge is shock-cooled with high pressure gas cooling.

As a result of this process a case hardening depth (550 HV 1) of 0.7 mm was obtained for a tooth flank.

With the aforedescribed method, employing a methane/propane mixture as the carbon-containing medium, to the carbon mass flow density during plasma carburization increased substantially without risking soot (carbon) deposition within the furnace.

The present invention is, of course, in no way restricted to the specific disclosure of the specification and drawing, but also encompasses any modifications within the scope of the appended claims.

What we claim is:

1. A method for producing a plasma carburization atmosphere for metal workpieces in a furnace, said method comprising the steps of:

providing process conditions of plasma carburization in a furnace;

introducing a mixture consisting mainly of propane and methane into the furnace atmosphere of the furnace in order to provide high carbon mass flow density and to prevent soot formation; and cleaving propane and methane under the process conditions of plasma carburization to release pure carbon at high carbon mass flow density into the furnace atmosphere for plasma carburization without soot formation.

2. A method according to claim 1, wherein the step of introducing includes preparing the mixture with up to 60 vol.-% of propane.

3. A method according to claim 1, wherein the step of introducing includes preparing the mixture with 5 to 50 vol.-% of propane.

4. A method according to claim 1, further comprising the step of adjusting the furnace atmosphere to a pressure of less than 10 mbar.

5. A method according to claim 1, wherein the step of introducing includes adding gases other than propane and methane to the furnace atmosphere.

6. A method according to claim 5, wherein the step of introducing includes adding hydrogen to the furnace atmosphere.

7. A method according to claim 5, wherein the step of introducing includes adding argon to the furnace atmosphere.

8. A method according to claim 5, wherein the step of introducing includes adding hydrogen and argon to the furnace atmosphere.

* * * * *